US005136303A

United States Patent [19]

Cho et al.

[11] Patent Number: 5,136,303

[45] Date of Patent: Aug. 4, 1992

[54] WRIST WATCH TYPE RECEIVER

[75] Inventors: Keizo Cho, Yokohama; Kenichi Kagoshima, Kanagawa; Kouichi Tsunekawa, Yokosuka; Hitoshi Itakura, Yokohama, all of Japan

[73] Assignee: Nippon Telegraph and Telephone Corporation, Tokyo, Japan

[21] Appl. No.: 656,809

[22] Filed: Feb. 19, 1991

[30] Foreign Application Priority Data

Feb. 20, 1990 [JP] Japan ..... 2-37396

[51] Int. Cl.[5] ..... H01Q 1/12

[52] U.S. Cl. ..... 343/718; 343/730; 343/895

[58] Field of Search ..... 343/718, 806, 720, 729, 343/895, 730

[56] References Cited

U.S. PATENT DOCUMENTS

| | | | |
|---|---|---|---|
| 3,032,651 | 5/1962 | Gisiger-Stahli | 435/269 |
| 4,754,285 | 6/1988 | Robitaille | 343/718 |
| 5,007,105 | 4/1991 | Kudoh et al. | 343/720 |

FOREIGN PATENT DOCUMENTS

| | | | |
|---|---|---|---|
| 0100639 | 2/1984 | European Pat. Off. . | |
| 0308935 | 3/1989 | European Pat. Off. . | |
| 55-104810 | 7/1980 | Japan . | |
| 56-87807 | 7/1981 | Japan . | |
| 56-172006 | 12/1981 | Japan . | |
| 57-132286 | 8/1982 | Japan . | |
| 59-42651 | 3/1984 | Japan . | |
| 60-35644 | 3/1985 | Japan . | |
| 60-193773 | 12/1985 | Japan . | |
| 0181202 | 8/1986 | Japan | 343/718 |
| 61-181203 | 8/1986 | Japan . | |
| 0252002 | 10/1988 | Japan . | |
| 2-1910 | 1/1990 | Japan . | |
| 2201266 | 8/1988 | United Kingdom . | |

OTHER PUBLICATIONS

"Wrist Strap Type Antenna System" by K. Horie, Patent Abstracts of Japan, vol. 11, No. 4 (E.468)(2451), Jan. 7, 1987.

*Primary Examiner*—Michael C. Wimer
*Assistant Examiner*—Tan Ho
*Attorney, Agent, or Firm*—Pollock, VandeSande and Priddy

[57] ABSTRACT

A pair of bands are each secured at one end to one side of a case wherein a radio receiver is housed, and a monopole antenna having a length of 0.005λ has one end connected to the feeding point of the radio receiver and its other end exposed to the outside of the case to form a contact portion for contact with the human body. A first helical antenna is supported to the one of the bands lengthwise thereof and is connected at one end to the feeding point. A second helical antenna is supported to the other band lengthwise thereof and is connected at one end to the common potential point of the radio receiver. The first and second helical antennas resonate, as one antenna, with the wavelength λ used by the radio receiver, and their pitch P and helix area A are selected so that $P<500A/\lambda$ and $P>150A/\lambda$. In an alternative embodiment first and second zigzag antennas are supported on said pair of bands respectively, and similarly connected to said feeding and common potential points instead of said helical antennas.

4 Claims, 8 Drawing Sheets

WRIST WATCH TYPE RECEIVER

BACKGROUND OF THE INVENTION

The present invention relates to a portable, wrist watch type receiver made to be fastened on a wearer's arm and, more particularly, relates to the antenna structure of such a receiver.

There has been proposed a small, portable receiver which employs a whip antenna However, this portable receiver is defective in that its gain decreases when it is used in close proximity to the human body. Another conventional portable receiver is one that uses a loop antenna. When this receiver is used near the human body, the antenna gain increases, but when it is used in free space apart from the human body, that is, when it is not carried on a wearer's arm, the antenna gain decreases In Japanese Patent Public Disclosure Gazette No. 181203/86 (laid open Aug. 13, 1986) there is disclosed a portable receiver of the type wherein a radio unit is housed in the case of a wrist watch and antennas are embedded in its bands. The antennas are each formed by a metal wire extended from the case lengthwise of one of the bands. In the free end portions of the bands where a plurality of small through holes are made for fastening the bands to each other, the metal wires are formed zigzag, passing between the holes in opposite directions. When the wrist watch is fastened on one's wrist, the zigzag portions of the metal wires embedded in the overlapping portions of the bands are electromagnetically coupled together and the metal wires perform the function of a loop antenna as a whole. When the wrist watch is not carried on the arm, the antenna gain is low.

It is disclosed in Japanese Utility Model Public Disclosure Gazettes No. 104810/80, 193773/85 and 132286/82 to hold the antenna of a portable radio receiver in contact with the human body to provide for enhanced sensitivity.

SUMMARY OF THE INVENTION

It is therefore an object of the present invention to provide a wrist watch type receiver whose sensitivity can be held sufficiently high regardless of whether it is carried on one's arm or placed in the free space.

According to an aspect of the present invention, a radio receiver is housed in a case and a pair of bands are each secured at one end to one side of the case. A monopole antenna, whose length is 0.15λ (where λ is the working wavelength of the radio receiver), has its one end connected to the feeding point of the radio receiver and has the other end exposed to the outside of the case to form a contact portion for contact with the human body. The contact portion may be formed by the one end of a conductor connected at the other end to the feeding point. Alternatively, a metal plate may be attached to the one end of the conductor to form the contact portion. A first helical antenna connected at one end to the feeding point is supported to the one of the bands and the center line of the first helical antenna extends lengthwise of the band. A second helical antenna is connected at one end to the common potential point of the radio receiver is supported to the other band, and its center line extends lengthwise of the other band. The geometry of the first and second helical antennas is selected so that they substantially resonate, as one antenna, with the wavelength of the frequency used by the radio receiver. Letting the helix area of each helical antenna, the pitch of the helical antenna and the wavelength be represented by A, P and λ, respectively, these parameters are selected such that $P<500A/\lambda$ and $P>150A/\lambda$.

Preferably, each helix of the first and second helical antennas has a rectangular section widthwise of the bands and a dielectric layer is provided in the bands so that the first and second helical antennas and the human body are spaced more than 0.0005λ apart when the wearer's bands are wrapped around the arm.

According to another aspect of the present invention, first and second zigzag antennas which extend in zigzag lengthwise of the bands are used in place of the above-mentioned first and second helical antennas The geometry of the first and second zigzag antennas is selected so that they substantially resonate, as one antenna, with the wavelength. Letting their widths, their pitches and the working wavelength be represented by W, P and λ, the parameters are selected so that $W<0.03\lambda$ and $P<0.84W$.

With such structures, when the wrist watch type receiver is carried on one's arm, the input impedance of the monopole antenna is lower than half of the input impedance of the first and second helical antennas (or first and second zigzag antennas) and the monopole antenna mainly functions as the receiving antenna. Since the length of the monopole antenna is selected shorter than 0.15λ, a large gain can be obtained. On the other hand, when the wrist watch type receiver is not carried on the arm, the monopole antenna works like a short open wire, its impedance is almost infinite. Accordingly, the input impedance of the first and second helical antennas (or first and second zigzag antennas) markedly decreases as compared with the input impedance of the monopole antenna, and consequently, the first and second helical antennas (or first and second zigzag antennas) function as the receiving antenna, in which case, since they are substantially resonant with the working wavelength, a large gain can be obtained Thus, the sensitivity of the wrist watch type receiver is relatively high enough for practical use, regardless of whether it is carried on one's arm or not.

DESCRIPTION OF THE PREFERRED EMBODIMENT

Figure 1A:
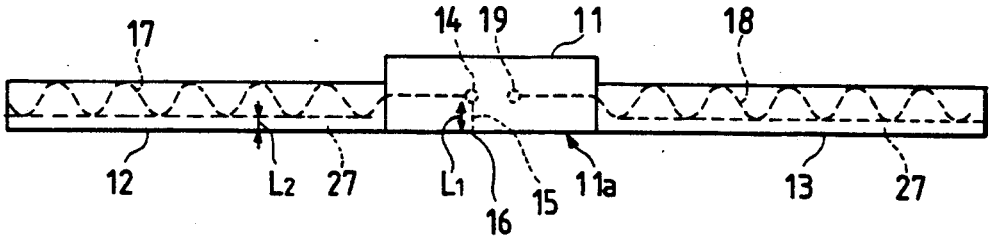
FIG. 1A is a front view illustrating an embodiment of the present invention which employs helical antennas.

FIG. 1A illustrates an embodiment of the present invention. A case 11 is generally a square or circular one, in which there are housed a radio receiver and a watch, though not shown. Extending from both sides of the case 11 are bands 12 and 13 secured at one end thereto and made to be wound around one's arm by clasps (not shown) on the bands 12 and 13. The case 11 and the bands 12 and 13 are made of, for example, synthetic resin in this embodiment.

A monopole antenna 15 is connected at one end to a feeding point 14 of the radio receiver housed in the case 11 and is exposed at the other end to the outside of the case 11 to form a contact portion 16 for contact with the human body. In this example, the bottom panel 11*a* of the case 11 has a small through hole, in which the other end of a conductor forming the monopole antenna 15 is inserted so that the end face of the conductor is flush with the underside of the bottom panel 11*a* to form the above-mentioned contact portion 16. The length $L_1$ of the monopole antenna 15 is selected to be smaller than 0.15 times the working wavelength $\delta$ of the receiver built in the case 11.

In the bands 12 and 13 there are embedded helical antennas 17 and 18, respectively. The center lines of the helical antennas 17 and 18 extend along the entire lengths of the bands 12 and 13. In this example, the helical antennas 17 and 18 are rectangular helical windings of conductors as shown on an enlarged scale and the long sides of the rectangles extend widthwise of the bands 12 and 13. The helical antenna 17 has its inner end connected to the feeding point 14 and the helical antenna 18 has its inner end connected to a common potential point 19 of the receiver in the case 11. The helical antennas 17 and 18 are wound in opposite directions, as viewed from the feeding point 14 and the common potential point 19, respectively. The geometry of each of the helical antennas 17 and 18, that is, the pitch P, the area A surrounded by the conductor as viewed from a direction perpendicular to the helix axis (which area will hereinafter be referred to as a helix area) and the number of turns, are selected such that the helical antennas 17 and 18 substantially resonate, as one antenna, at the wavelength $\delta$ when a feeding power source (a load, in practice, because they are connected to the receiver) is connected between the feeding point 14 and the common potential point 19. Further, the pitch P and the helix area A are selected so that $P<500A/\lambda$ and $P>150A/\lambda$.

Figure 2A:
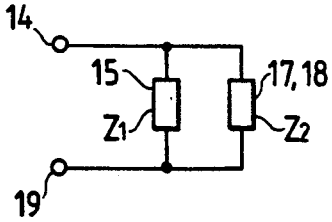
FIG. 2A is an equivalent circuit diagram of the antenna portion in FIG. 1A.
Figure 2B:
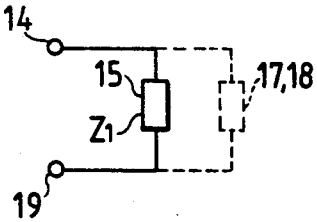
FIG. 2B is an equivalent circuit diagram of the antenna portion when the receiver of FIG. 1A is carried on one's arm.

A description will be given of the reasons therefor. In the receiver mounted in the case 11 the monopole antenna 15 of an input impedance $Z_1$ and the helical antennas 17 and 18 of an input impedance $Z_2$ (which operate as one helical antenna) are connected in parallel between the same feeding point 14 and the common potential point 19 as shown in FIG. 2A. With the selection of the above-mentioned values, however, when the wrist watch type receiver is carried on one's arm, the contact portion 16 of the monopole antenna 15 is in contact with the arm, i.e. the human body, and its input impedance $Z_1$ decreases to a value ranging from 150 to 300 Ω, whereas the helical antennas 17 and 18 are held close to the human body and their input impedance $Z_2$ becomes higher than 600 Ω. That is, the input impedances $Z_1$ and $Z_2$ bear a relation $Z_1 \leqq Z_2$, and current flowing across the helical antennas 17 and 18, viewed from the feeding point 14, becomes ⅓ to 1/5 the current flowing across monopole antenna 15 mainly operates as an antenna, as shown in FIG. 2B, providing a large gain.

Figure 2C:
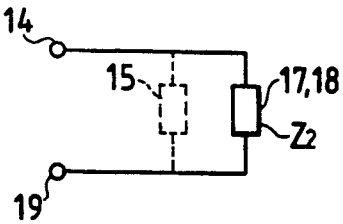
FIG. 2C is an equivalent circuit diagram of the antenna portion when the receiver of FIG. 1A is placed in a free space.

On the other hand, when the wrist watch type receiver is held in a free space, not on the arm, the monopole antenna 15 does not contact the human body and exists merely as a wire shorter than 0.15λ; namely, the tip of the monopole antenna 15 is open and its input impedance $Z_1$ is considered to be infinite In this instance, since the helical antennas 17 and 18 are not in contact with the human body, the input impedance $Z_2$ becomes 20 to 50 Ω. As shown in FIG. 2C, the monopole antenna 15 is disconnected and only the helical antennas 17 and 18 act as an antenna, obtaining a large gain close to that of a half-wave dipole antenna.

Next, it will be described, based on experimental data, that such a relationship between gain and input impedance as mentioned above is obtained by selecting the values P and A as referred to in the above.

Figure 3A:
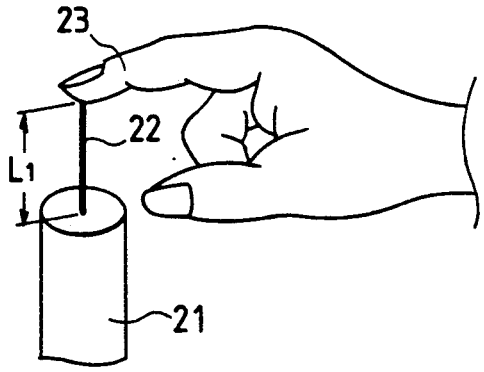
FIG. 3A is a perspective view showing the state in which the tip of a coaxial type monopole antenna is touched with a fingertip.
Figure 3B:
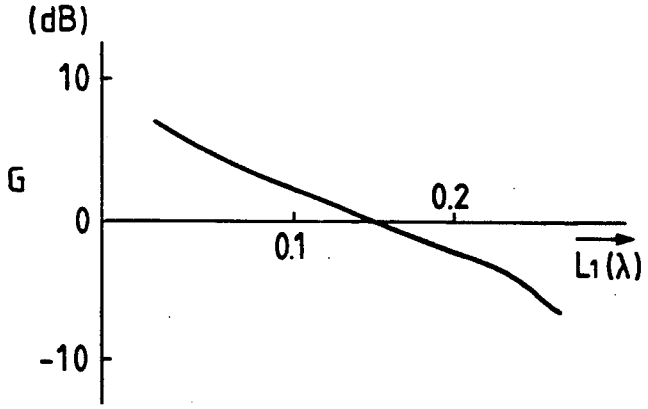
FIG. 3B is a graph showing experimental values of the relationship between the length $L_1$ and gain of the antenna depicted in FIG. 3A.

FIG. 3A shows a monopole antenna with an inner conductor 22 of a coaxial cable 21 projecting out therefrom by a length $L_1$. FIG. 3B shows variations caused in the gain of the monopole antenna when the length $L_1$ was varied with a fingertip 23 held in contact with the tip of the inner conductor 22. In FIG. 3B the abscissa represents the length $L_1$ expressed in terms of the working wavelength δ and the ordinate represents the antenna gain G standardized using the antenna gain when the inner conductor 22 is not touched with the fingertip 23. That is, 0 dB is the gain when the inner conductor 22 is not touched with the fingertip 23. It appears from FIG. 3B that as the length $L_1$ decreases, the gain increases and that when the length $L_1$ becomes shorter than 0.15 λ, the gain becomes greater than that when the antenna is not held in contact with the human body. In the present invention, the length $L_1$ of the monopole antenna 15 is therefore selected to be 0.15 λ as mentioned previously.

Figure 4A:
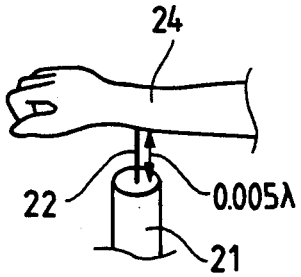
FIG. 4A is a diagram showing the state in which the tip of the antenna depicted in FIG. 3A is touched with an arm.

In the case where the length $L_1$ of the inner conductor 22 in the monopole antenna depicted in FIG. 3A was 0.005 λ and the tip of the conductor 22 was touched with an arm 24 as shown in FIG. 4A, the input impedance of this antenna was about 300 Ω in absolute value.

Figure 5A:
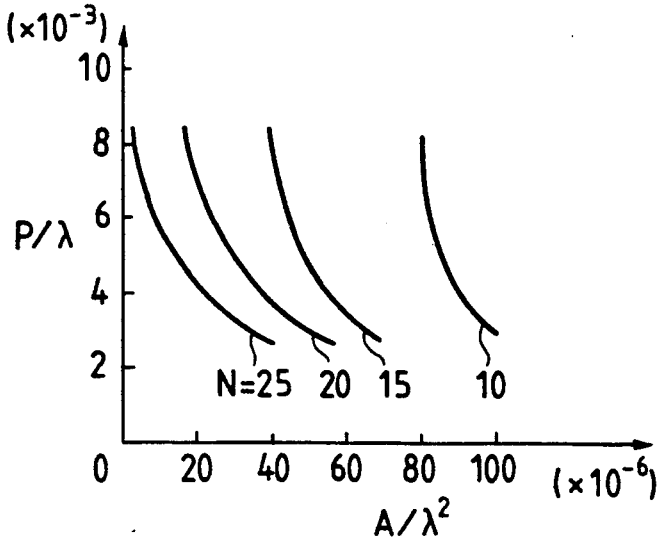
FIG. 5A is a graph showing the relationships between the helix area A and the pitch P of square helical antennas during their resonance state, using the number of turns N as a parameter.

FIG. 5A shows the relationships between the helix area A, the pitch P and the number of turns N (half side of the helical antenna) of each square helical antenna obtained when they resonate at a given wavelength λ. In FIG. 5A the abscissa represents the helix area $A/\lambda^2$, the ordinate represents the pitch $P/\lambda$ and the parameter used is the number of turns N. FIG. 5A indicates that when the number of turns N is held constant, the pitch P must be decreased as the helix area A increases to get a resonance, that when the pitch P is held constant, the number of turns N must be decreased as the helix area A increases, and that when the helix area A is held constant the number of turns N must be decreased as the pitch P increases. The geometry of each of the helical antennas 17 and 18, that is, the helix area A, the pitch P and the number of turns N are chosen to satisfy the relationships shown in FIG. 5A so that they resonate at the given frequency.

Figure 5B:
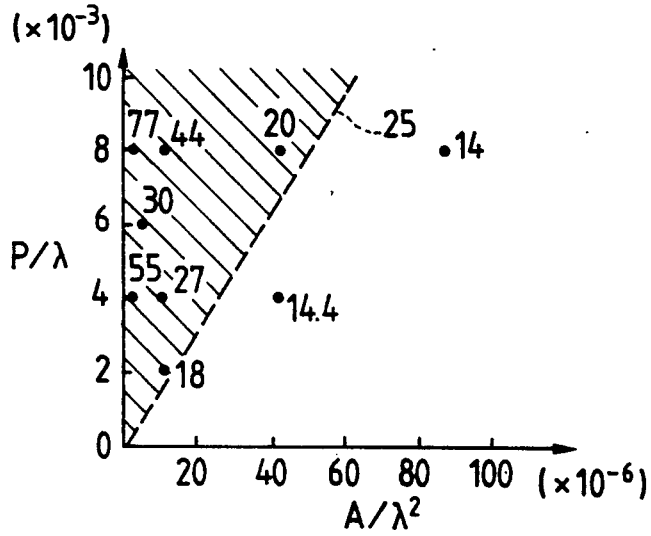
FIG. 5B is a graph showing the input impedances of the square helical antennas, measured for various values of the helix area A and the pitch P.

FIG. 5B shows the input impedance of each of the square helical antennas in their resonant state. The abscissa represents the helix area $A/\lambda^2$ and the ordinate represents the pitch $P/\lambda$, numerical values stated in the graph being the input impedance. For example, the numerical value 14.4 is the input impedance when $A/\lambda^2$ is about $40\times10^{-6}$ and $P/\lambda$ is $4\times10^{-3}$. The straight line 25 is a line on which an experimental formula $P/\lambda=150\ A/\lambda^2$ holds. In the hatched region above the straight line 25 wherein the condition $P>150\ A/\lambda$ is satisfied, the input impedance exceeds 20 Ω, and at a limit A=0, this antenna acts as a dipole antenna, in which case the input impedance is about 80 Ω. In the case where the input impedance is in the range of 20 to 100 Ω, even if the antenna is connected directly to the receiver of a standard input impedance (usually 50 Ω), the VSWR (that is, the voltage standing wave ratio) becomes lower than 2 and the gain of the helical antenna during resonance is close to the gain of a half-wave dipole antenna, substantially −2 to −5 dBd (dBd is the unit with the gain of the half-wave dipole antenna assumed to be zero). In view of the above, the condition $P>150\ A/\lambda$ is used in the present invention.

Figure 5C:
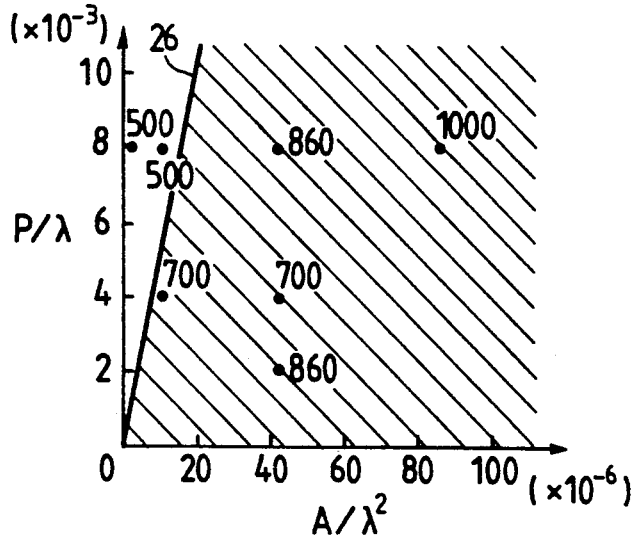
FIG. 5C is a graph showing the input impedances of the square helical antennas, measured for various values of the helix area A and the pitch P when the antennas were held close to the human body.

FIG. 5C shows the relationship between a maximum value of the absolute value of the input impedance, the helix area A and the pitch P in the case where the square helical antenna is held close to a position substantially in contact with the human body. The straight line 26 is a line on which an experimental formula $P/\lambda=500\ A/\lambda^2$ is satisfied. In the hatched region under the straight line 26, the input impedance becomes higher than about 600 Ω, and when the monopole antenna 15 is held in contact with the human body, it mainly performs the function of the main antenna rather than the helical antennas 17 and 18. For this reason, the condition $P<500\ A/\lambda$ is used in the present invention.

Figure 6A:
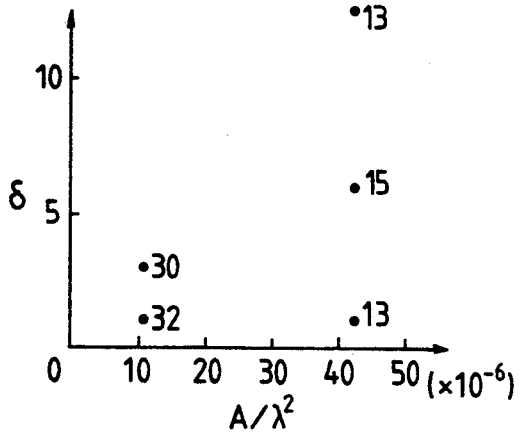
FIG. 6A is a graph showing the input impedances of helical antennas whose pitch P was $4\lambda\times10^{-3}$, measured for various values of an aspect ratio $\delta$ (a value obtained by dividing the long side of a square defining the helix area A, by the short side of the square) and the helix area A.
Figure 6B:
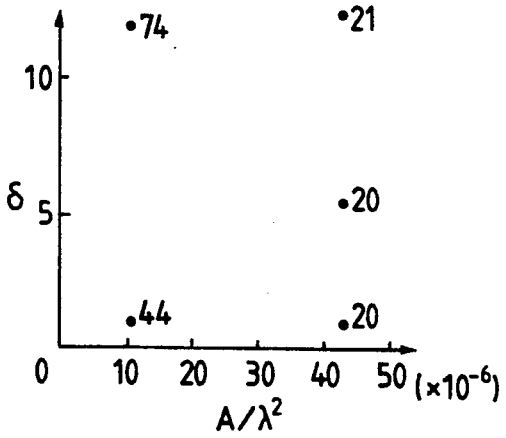
FIG. 6B is a graph showing the input impedances of helical antennas whose pitch P was $8\lambda\times10^{-3}$, measured for various values of the aspect ratio $\delta$ and the helix area A.
Figure 6C:
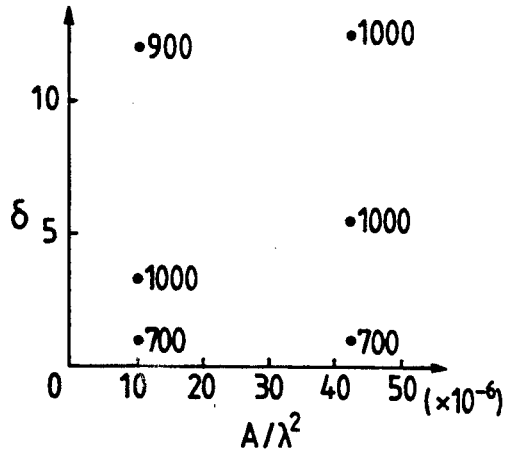
FIG. 6C is a graph showing the input impedances of helical antennas whose pitch P was $4\lambda\times10^{-3}$, measured for various values of the aspect ratio $\delta$ and the helix area A when they were held close to the human body.
Figure 6D:
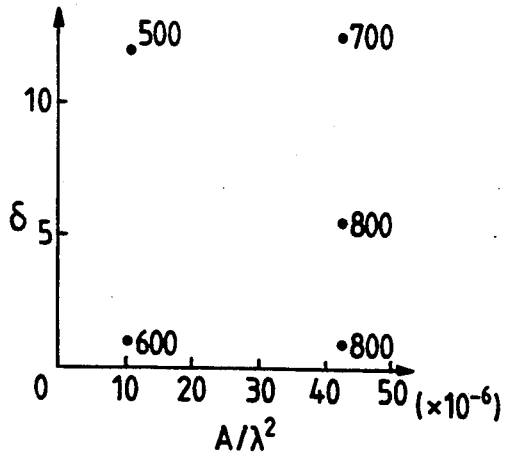
FIG. 6D is a graph showing the input impedances of helical antennas whose pitch P was $8\lambda\times10^{-3}$, measured for various values of the aspect ratio $\delta$ and the helix area A when they were held close to the human body.

Next, it will be described that the above-mentioned relationships are also obtainable in the case where the shape of the region which determines the helix area A of the helical antenna is not square but rectangular, that is, in the case of a flat helical antenna. FIGS. 6A and 6B show, in connection with pitches $P=4\lambda\times10^{-3}$ and $P=8\lambda\times10^{-3}$, the input impedance of the helical antenna in the free space, measured with respect to changes in the helix area A and an aspect ratio δ=a/b (square δ=1) obtained by dividing the length a of the long side of the area which determines the helix area A, by the length b of the short side thereof. In FIG. 6A, when the helix area A is $A/\lambda^2=10\times10^{-6}$, the input impedance is about 31 Ω irrespective of the aspect ratio, and when $A/\lambda^2$ is about $40\times10^{-6}$, even if the aspect ratio varies, the input impedance is around 14 Ω and remains unchanged. FIG. 6B also shows that the input impedance remains substantially unchanged, even if the aspect ratio is changed. In Figs. 6C and 6D there are shown, in connection with pitches $P=4\lambda\times10^{-3}$ and $P=8\lambda\times10^{-3}$, the relationships between the helix area A of a maximum value of the absolute value of the input impedance of the helical antenna held close to the human body, the helix area A and the aspect ratio. It will be seen that when the aspect ratio is selected large, the absolute value of the input impedance tends to increase and exceeds 600 Ω in either case.

FIG. 6 indicates that the helical antennas 17 and 18 may be square, rectangular, circular, or elliptic in shape.

Figure 7A:
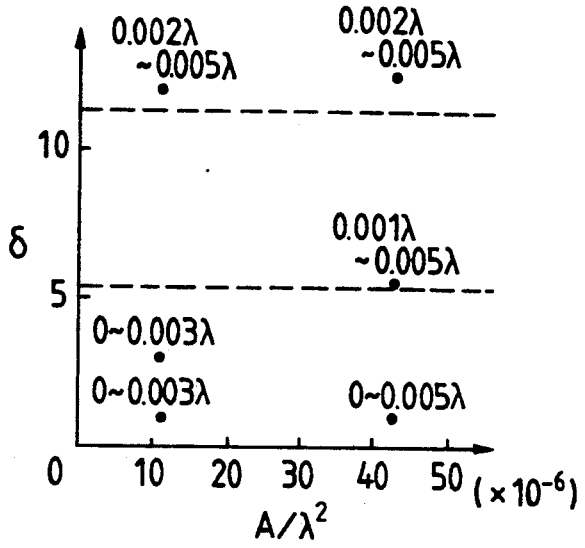
FIG. 7A is a graph showing the distances between the helical antennas whose pitch P was $4\lambda\times10^{-3}$and the human body necessary for obtaining input impedance higher than 600 Ω, measured for various values of the aspect ratio $\delta$ and the helix area A when the antennas were held close to the human body.
Figure 7B:
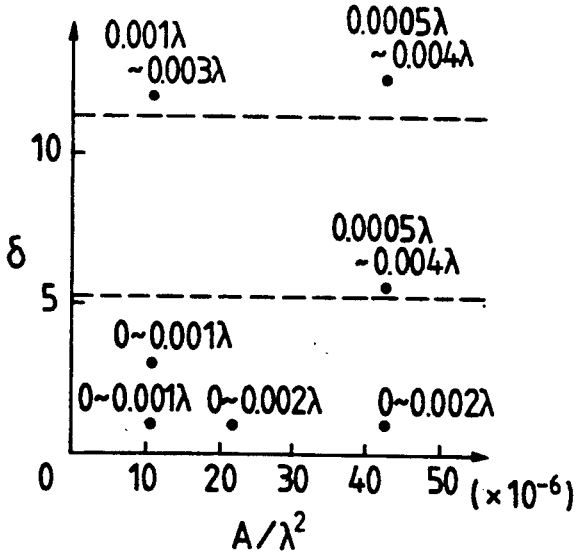
FIG. 7B is a graph showing the distances between the helical antennas whose pitch P was $8\lambda\times10^{-3}$and the human body necessary for obtaining input impedance higher than 600 Ω, measured for various values of the aspect ratio $\delta$ and the helix area A when the antennas were held close to the human body.

FIG. 7 shows the distance $L_2$ (see FIG. 1A) between the helical antenna and the human body in the case where the absolute value of the input impedance is greater than 600 Ω, FIG. 7A showing the distance in the case of $P=4\lambda\times10^{-3}$ and FIG. 7B the distance in the case of $P=8\lambda\times10^{-3}$. In FIG. 7A, when the aspect ratio δ is less than 5.5, in the range of between 5.5 and 11 and greater than 11, the distance $L_2$ needs to be selected in the ranges of 0 to 0.003, 0.001 to 0.005λ and 0.002 to 0.005λ, respectively, regardless of the helix area A. The black circles indicate measured points. In FIG. 6B, when the aspect ratio δ is in excess of 5.5, the distance $L_2$ needs to be chosen in the range of 0.0005 to 0.004λ. Thus, when the aspect ratio δ is equal to or greater than 5.5, it is necessary that the undersides of the bands 12 and 13 which contact the user's arm and the helical antennas 17 and 18 be spaced apart the distance $L_2$ equal to or greater than 0.0005λ in FIG. 1, for instance. In other words, the wrist watch type receiver is formed so that when it is carried on the user's arm, a dielectric layer 27 of the 0.0005λ or more thickness, which may preferably be determined by the conditions shown in FIG. 7, is interposed between the human body and the helical antennas 17 and 18. In FIG. 1A the bands 12 and 13 partly form the interposed layer 27.

Figure 1B:
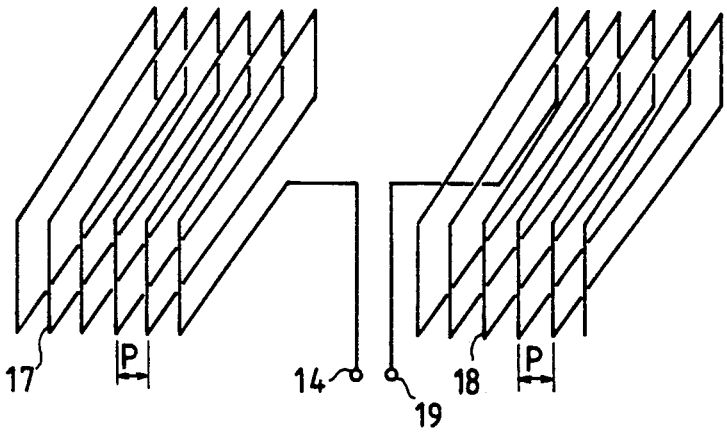
FIG. 1B is an enlarged perspective view showing helical antennas 17 and 18 used in the FIG. 1A embodiment.
Figure 8A:
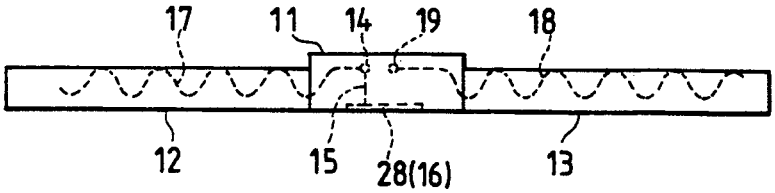
FIG. 8A is a front view illustrating a modified form of the embodiment shown in FIG. 1A.

It is also possible to employ a construction in which a conductor plate 28 is embedded in or stuck to the underside of the case 11 and the monopole antenna 15 is connected at one end to the conductor plate 28 to form the contact portion 16 for contact with the human body, as shown in FIG. 8A in which the parts corresponding to those in FIG. 1 are identified by the same reference numerals With this construction, the gain of the monopole antenna 15 can be increased.

Figure 4B:
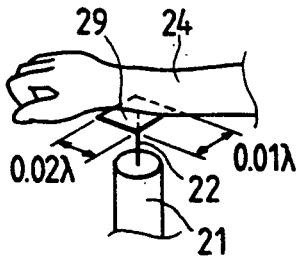
FIGS. 4B and 4C are diagrams each showing the state in which a metal plate attached to the tip of the antenna depicted in FIG. 3A is touched with an arm.
Figure 4C:
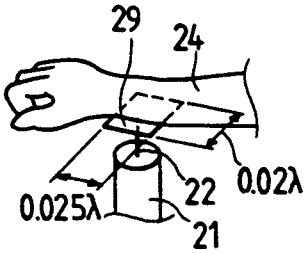
Figure 9A:
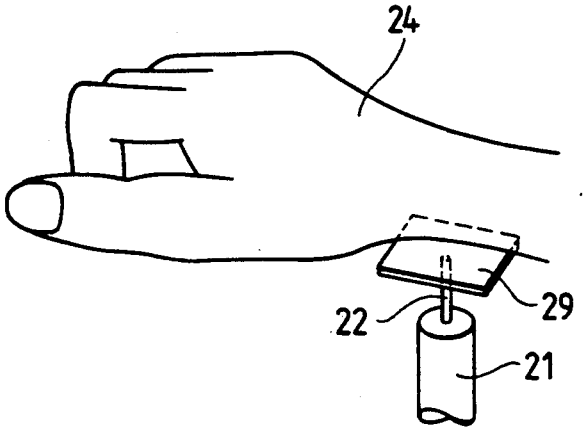
FIG. 9A is a perspective view showing the state in which a metal plate 29 attached to the tip of a coaxial monopole antenna was touched with an arm.
Figure 9B:
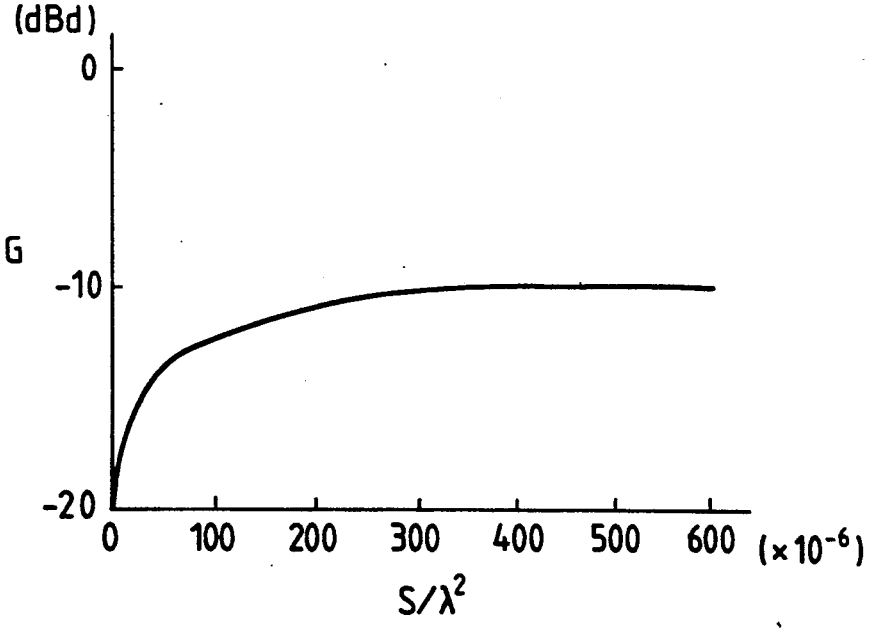
FIG. 9B is a graph showing variations in the gain of the monopole antenna depicted in FIG. 9A, measured with respect to the area of the metal plate 29.

In the case where a square metal plate 29 was connected centrally thereof to the tip of the inner conductor 22 ($L_1$=0.005λ) of the monopole antenna 15 depicted in FIG. 3A and was touched with the arm 24, as shown in FIG. 9A, the area S of the metal plate 29 and the gain G of the antenna bore such a relationship as shown in FIG. 9B. It appears from FIG. 9B that as the area S increases, the gain G sharply increases but its increase becomes gradually saturated. As depicted in FIGS. 4B and 4C, the input impedances when rectangular metal plates measuring 0.01×0.02λ and 0.02×0.025λ are used as the metal plate 29, are about 150 Ω and about 200 Ω, respectively, and they are smaller than 300 Ω or so in the case of the metal plate 29 is not used. This indicates that the provision of the conductor plate 28 as shown in FIG. 8A causes an increase in the gain of the monopole antenna 15 and can be used in combination with the helical antennas. It is also possible to adopt a construction in which the bottom panel 11*a* of the case 11 is formed by a metal back cover, to which one end of the monopole antenna is connected so that the back cover acts as plate 28 and forms the contact portion 16. The monopole antenna 15 may be connected to the conductor plate 28 at any positions thereon, not always centrally thereof.

Figure 8B:
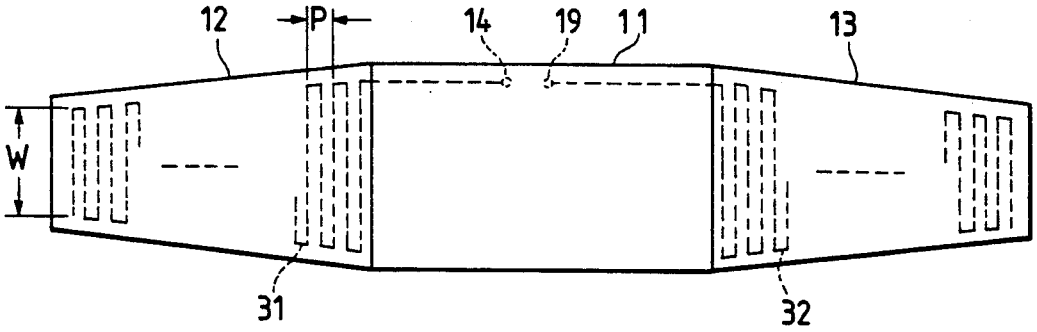
FIG. 8B is a front view illustrating another embodiment of the present invention which employs zigzag antennas.
Figure 8C:
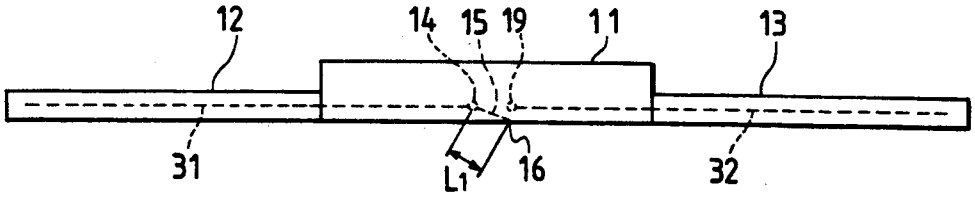
FIG. 8C is a front view of the embodiment depicted in FIG. 8B.

FIGS. 8B and 8C illustrate another embodiment of the present invention, in which the parts corresponding to those in FIG. 1 are identified by the same reference numerals. This embodiment employs zigzag antennas 31 and 32 in place of the helical antennas 17 and 18. The zigzag antenna 31 extends zigzag in the band 12 from one end to the other and its inner end is connected to the feeding point 14. The zigzag antenna 32 is also formed in the same manner and the its inner end is connected to the common potential point 19. Each bent portion of the zigzag antenna 31 and 32 is preferably U-shaped, triangular or meander.

Figure 10A:
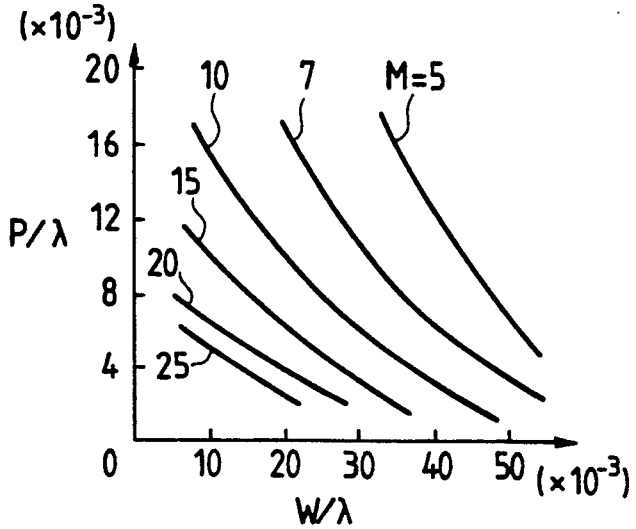
FIG. 10A is a graph showing the relationships between the width W and the pitch P of the zigzag antenna, using the number of bends M as a parameter.

The configuration of zigzag antennas 31 and 32 is selected so that, viewed from the feeding point 14 and the common potential point 19 when the receiver is placed in the free space apart from the human body, the antennas function as one antenna substantially resonant with the wavelength λ. For example, in the case where a feeding source is connected between inner ends of a pair of zigzag antennas, each of which is formed by a strip-like copper wire 0.001λ in thickness and bent in the U-letter shape at both ends of each segment and has its width W held constant, the zigzag antennas function as one antenna resonant with the wavelength λ when the antenna width W, the pitch P and the number of turn-down M at one side bear such relationships shown in FIG. 10A. The curves in FIG. 10A each show the relationship between the area A and the pitch P for resonance, using the number of turn-down M as a parameter. In the FIG. 8B embodiment the antenna width W of each of the zigzag antennas 31 and 32 is gradually varied, but the same relationship as shown in FIG. 10A exists and the antenna width W, the pitch P and the number of bends M of each of the zigzag antennas 31 and 32 are chosen so that they essentially resonate with a given wavelength λ.

Figure 10B:
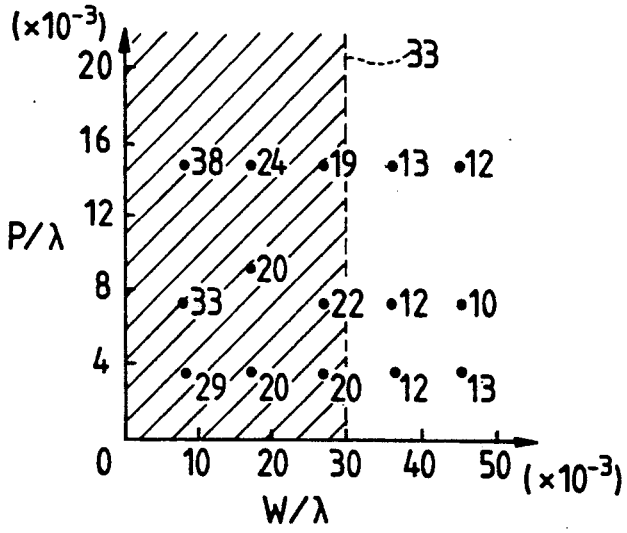
FIG. 10B is a graph showing input impedances of the zigzag antennas, measured for various values of their widths W and pitches P.

Further, the antenna width W of each of the zigzag antennas 31 and 32 is selected smaller than 0.003λ so that the input impedance during resonance in the free space exceeds 20 Ω; by this, the zigzag antennas can be connected directly to a receiver of a standard input impedance. FIG. 10B snows the input impedance of the zigzag antenna used for the experiments in FIG. 10A, measured for various values of the antenna width W and the pitch P. The line 33 is a line on which W=0.03λ. When the antenna width W is greater than the line 33, the input impedance becomes lower than 20 Ω and this antenna cannot be connected directly the receiver. The input impedance has nothing to do with the pitch P. The antenna width W and the pitch P are selected in the hatched region in which W<0.03λ.

Figure 10C:
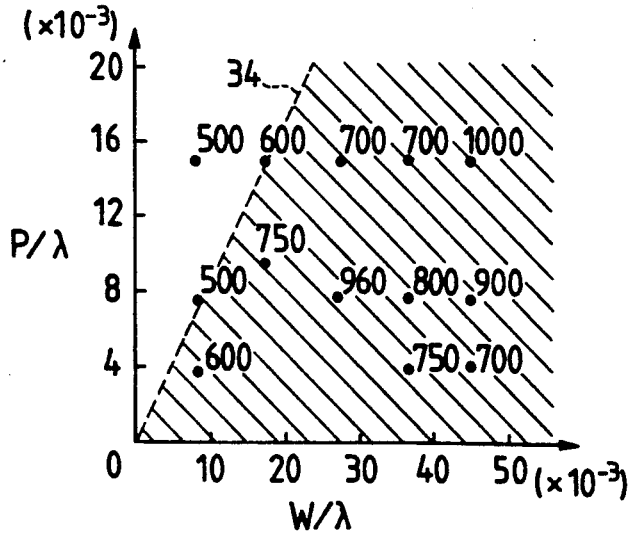
FIG. 10C is a graph showing input impedances of the zigzag antennas, measured for various values of the width A and pitch P when they were held close to the human body.

Moreover, the pitch P is selected smaller than 0.84W so that when the wrist watch type receiver is carried on the arm, the input impedance of the zigzag antennas 31 and 32 may exceed 600 Ω and the monopole antenna 15 mainly functions as an antenna. FIG. 10C shows maximum values of the absolute value of the input impedance of the above-said zigzag antenna held substantially in contact with the human body, measured for various values of the antenna width W and the pitch P. The straight line 34 indicates an experimental formula P=0.84. In the region above the straight line 34, the input impedance is lower than 600 Ω, accordingly the antenna width W and the pitch P are selected in the underlying hatched region in which P<0.84W. In this instance, the input impedance will exceed 600 Ω, if the human body and the zigzag antennas 31 and 32 are spaced 0.001λ or less apart and the pitch P and the antenna width W are within the ranges in which they satisfy the afore-mentioned relationships.

It will easily be understood that, with the structure of the embodiment shown in FIG. 8B, when the receiver is carried on the arm, the monopole antenna 15 mainly functions and obtains a high gain, and when the receiver is held apart from the arm, the zigzag antennas and 32 serve as an antenna and obtain a high gain, as in the embodiment of FIG. 1. Also in the embodiment of FIG. 8B the contact portion 16 of the monopole antenna 15 may be formed by the aforementioned conductor plate 28. In either of the embodiments depicted in FIGS. 1 and 8B the helical antennas 17 and 18 and the zigzag antennas 31 and 32 need not always be embedded in the bands 12 and 13 but may also be provided in contact with the bands 12 and 13 at one side thereof or mounted on the outside of them, and the helical antennas 17 and 18 may also be wound around the bands 12 and 13. In such cases, the exposed helical antennas 17 and 18 and the zigzag antennas 31 and 32 are each coated with an insulating film or formed by a conductor coated with an insulating film.

As described above, according to the wrist watch type receiver of the present invention, when it is carried on the arm, the input impedances of the helical antennas 17 and 18 or the zigzag antennas 31 and 32 rise, the monopole antenna 15 is held in contact with the human body and only this antenna 15 performs the function of an antenna and obtains a high gain. When the receiver is not on the arm, the input impedance of the monopole antenna 15 is substantially infinite, the helical antennas 17 and 18 or the zigzag antennas 31 and 32 enter the resonant state, and their input impedance becomes about 20 Ω, so that the antennas can be connected to the receiver without using a matching circuit and a high gain can be obtained. Thus, the operation of the receiver of the present invention is excellent, regardless of whether it is carried on the arm or not.

In the case where the helical antennas 17 and 18 in the FIG. 1 embodiment were 0.16λ long, the long and short sides of each rectangle defining the helix area were 0.02 and 0.002λ, respectively, and the number of turns N was 24, the helix area was $34\times10^{-6}/\lambda^2$ and the pitch was $6.3\times10^{-3}/\lambda$, and consequently, the aforementioned conditions were satisfied. When the receiver was not on the arm, the helical antennas 17 and 18 resonated, and when the receiver was carried on the arm, their input impedance was above 600 Ω. When the length $L_1$ of the monopole antenna 15 was 0.005λ, the antenna gain was −15 dBd when the receiver was carried on the arm and −5 dBd when the receiver was not on the arm.

In the case where the zigzag antennas 31 and 32 in the FIG. 8B embodiment were each formed by bending, in zigzag, a strip-like conductor of a $5\times10^{-4}$ line width, the pitch P was 0.0015λ, the antenna width W was 0.03λ toward the case 11 and 0.017λ toward the free end of each band, the number of bends M of each antenna was 21.5, the distances from the feeding point 14 and the common potential point 19 to the antennas were each 0.024λ and the length $L_1$ of the monopole antenna 15 was 0.005λ, and the antenna gain was −15 dBd when the receiver was carried on the arm and −15 dBd when the receiver was not on the arm.

It will be apparent that many modifications and variations may be effected without departing from the scope of the novel concepts of the present invention.

We claim:

1. A wrist watch type receiver comprising:
   - a case having a radio receiver housed therein;
   - a pair of bands each secured at one end to one side of said case and made to be wrapped around a wearer's arm;
   - a monopole antenna having one end connected to a feeding point of said radio receiver and having the other end exposed to the outside of said case to form a contact portion for contact with the wearer's body, the length of said monopole antenna being equal to or shorter than 0.15 λ where λ is the wavelength of the frequency used by said radio receiver;
   - a first helical antenna connected at one end to said feeding point, said first helical antenna being supported by one of said bands and extended lengthwise thereof so that $P< 500A/\lambda$ and $P>150A/\lambda$ where P is the pitch of helical segments of said first helical antenna and A is the helix area defined by each of said segments, viewed from a direction perpendicular to the axis of each band; and
   - a second helical antenna having the same helical segment pitch P and the same helix area A as the pitch P and helix area A of said first helical antenna, said second helical antenna being connected at one end to a common potential point of said radio receiver, and said second helical antenna being supported by the other of said bands and extended lengthwise thereof so that $P<500A/\lambda$ and $P>150A/\lambda$ in said second helical antenna, said second helical antenna substantially resonating with said wavelength λ together with said first helical antenna.

2. The wrist watch type receiver of claim 1, wherein a region which defines said helix area of each of said first and second helical antennas is rectangular and the long side of said rectangle extends widthwise of each of said bands, and wherein a dielectric layer having a thickness equal to or greater than 0.0005λ is provided for separating said first and second helical antennas from the wearer's body when said wrist watch type receiver is fastened on said arm.

3. A wrist watch type receiver comprising:
   - a case having a radio receiver housed therein;
   - a pair of bands each secured at one end to one side of said case and made to be wrapped around a wearer's arm;
   - a monopole antenna having one end connected to a feeding point of said radio receiver and having the other end exposed to the outside of said case to form a contact portion for contact with the wearer's body, the length of said monopole antenna being equal to or shorter than 0.15λ wherein λ is the wavelength used by said radio receiver;
   - a first zigzag antenna connected at one end to said feeding point, said first zigzag antenna being supported by one of said bands and extended in zigzag lengthwise thereof so that $W<0.30\lambda$ and $P>0.84W$ where W is the antenna width and P is the pitch of segments of said first zigzag antenna; and
   - a second zigzag antenna having the same antenna width W and the said pitch P as the width W and pitch P of said first zigzag antenna, said second zigzag antenna being connected at one end to a common potential point of said radio receiver, and said second zigzag antenna being supported by the other of said bands and extended in zigzag lengthwise thereof so that $W<0.03\lambda$ and $P<0.84W$ in said second zigzag antenna, said second zigzag antenna substantially resonating with said wavelength λ together with said first zigzag antenna.

4. The wrist watch type receiver of any one of claims 1 to 3, wherein said contact portion of said monopole antenna is formed by a conductor plate.

* * * * *